US007398657B2

(12) United States Patent
Cleofas

(10) Patent No.: US 7,398,657 B2
(45) Date of Patent: Jul. 15, 2008

(54) DECORATIVE RING AND GUARD

(76) Inventor: Irene Cleofas, 2305 Valwood Ave., El Monte, CA (US) 91732

( * ) Notice: Subject to any disclaimer, the term of this patent is extended or adjusted under 35 U.S.C. 154(b) by 38 days.

(21) Appl. No.: 11/371,676

(22) Filed: Mar. 8, 2006

(65) Prior Publication Data

US 2006/0218969 A1 Oct. 5, 2006

Related U.S. Application Data

(60) Provisional application No. 60/697,678, filed on Jul. 8, 2005, provisional application No. 60/661,522, filed on Mar. 12, 2005.

(51) Int. Cl.
*A44C 9/00* (2006.01)

(52) U.S. Cl. ..... 63/15; 63/15.7

(58) Field of Classification Search ..... None
See application file for complete search history.

(56) References Cited

U.S. PATENT DOCUMENTS 5,253,490 A * 10/1993 Doganay ..... 63/15.4
5,419,158 A * 5/1995 Sandberg et al. ..... 63/15.4
5,727,399 A * 3/1998 Bergagnini ..... 63/15.4

* cited by examiner

*Primary Examiner*—Jack W. Lavinder
(74) *Attorney, Agent, or Firm*—Paul J. Backofen, Esq.; Crockett & Crockett

(57) ABSTRACT

Finger ring sets according to the present disclosure include a primary ring with one or more precious stones and or other ornamentation. A secondary ring may be hinged to engage and enclose the primary ring, the combination of the primary ring and the secondary ring presenting the image of a single ring. The secondary ring may include one or more precious stones and or other ornamentation and may be hinged with either a north-south or an east-west orientation. Portions of the secondary ring may also engage each other or the primary ring to further secure the primary ring.

2 Claims, 3 Drawing Sheets

DECORATIVE RING AND GUARD

RELATED APPLICATIONS

This application claims the priority of copending U.S. provisional patent application 60/661,522 filed Mar. 12, 2005 and copending U.S. provisional patent application 60/697,678 filed Jul. 8, 2005.

FIELD OF THE INVENTION

The present invention relates generally to the field of decorative ring sets and more specifically to nested ring and guard sets.

BACKGROUND OF THE INVENTION

Conventional decorative finger rings such as a woman's wedding ring may be worn with one or more ring guards. Conventional wedding ring sets such as the engagement ring and wedding ring guard may also be inconvenient and or uncomfortable to wear owing to misalignment of the ring profiles or misalignment of precious stones or other ornamentation.

What is needed is are finger rings and ring guards sized and fitted to be worn together without misalignment or discomfort and presenting the appearance of a single ring.

SUMMARY

Finger ring sets according to the present disclosure include a primary ring with one or more precious stones and or other ornamentation. A secondary ring is hinged to engage and enclose the primary ring, the combination of the primary ring and the secondary ring presenting the image of a single ring. The secondary ring may include one or more precious stones and or other ornamentation and may be hinged with either a north-south or an east-west orientation. Portions of the secondary ring may also engage each other or the primary ring to further secure the primary ring.

In a first aspect, the present disclosure includes a primary ring having a first cross section profile, and two or more engagement elements for engaging the secondary ring. The primary ring may be worn alone or combined with the secondary ring. Similarly, the secondary ring may be worn alone or combined with the primary ring.

In another aspect of the present disclosure a secondary ring includes a cross section relief to accommodate and engage the primary ring. In a ring set according to the present disclosure, a primary ring engaged and enclosed by a secondary ring appear as a single ring when viewed from the side or the end.

In an alternate configuration the ring set includes a primary ring as above, the secondary ring may be composed of two or more ringlets that may be hinged or otherwise joined together such that the secondary ring ringlets securely engage the primary ring. The primary ring may only be disengaged by separating the ringlets.

In another alternate configuration the secondary ring may include one or more apertures permitting one or more areas of the primary ring to be viewed when the primary ring is engaged within the secondary ring.

These and other features and advantages will become further apparent from the detailed description and accompanying figures that follow. In the figures and description, numerals indicate the various features of the disclosure, like numerals referring to like features throughout both the drawings and the description.

DETAILED DESCRIPTION OF THE INVENTIONS

Figure 1:
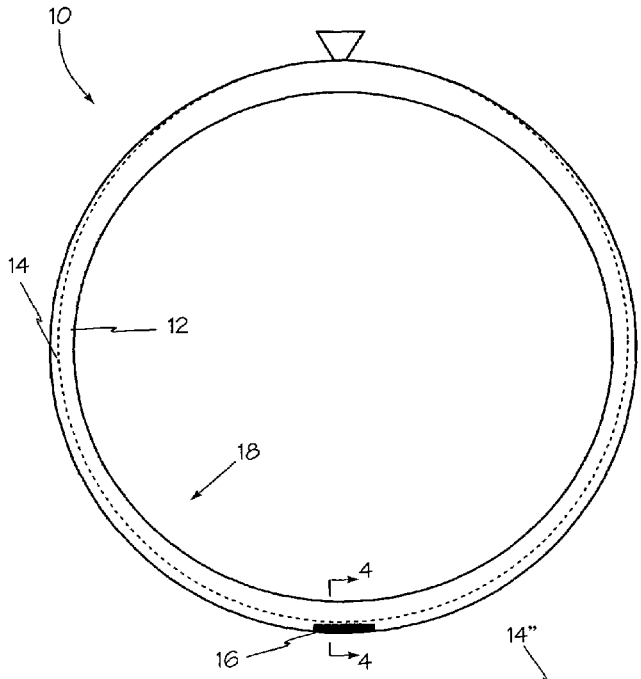
FIG. 1 is a side view of an east-west ring set according to the present disclosure.

Referring now to FIG. 1, ring set 10 includes primary ring 12 enclosed by secondary ring 14. Primary ring 12 and secondary ring 14 are illustrated as generally toroidal in shape. It should be understood that the primary and secondary ring illustrations do not include additional ornamentation for the sake of clarity. Secondary ring 14 is composed of first portion 14' joined to second portion 14" by hinge 16. Secondary rings such as secondary ring 14 include a channel, opening, inset or relief area such as relief area 18 sized to accommodate, engage, and envelope primary rings such as primary ring 12. Relief area 18 may be allocated as necessary between portions of a secondary ring such as first relief portion 18' within first ring portion 14' of secondary ring 14, and second relief portion 18" within second ring portion 14" of secondary ring 14.

Ring set 10 further includes east-west oriented hinge 16. Hinge 16 provides a pivotal area of engagement between first ring portion 14' and second ring portion 14". Hinge 16 may be included within the profile of secondary ring 14 or it may be external. East-west hinge orientation includes the hinge pivot in the same plane, or parallel to the plane of the secondary ring. North-south hinge orientation has the hinge pivot perpendicular to the plane of the secondary ring.

Figure 2:
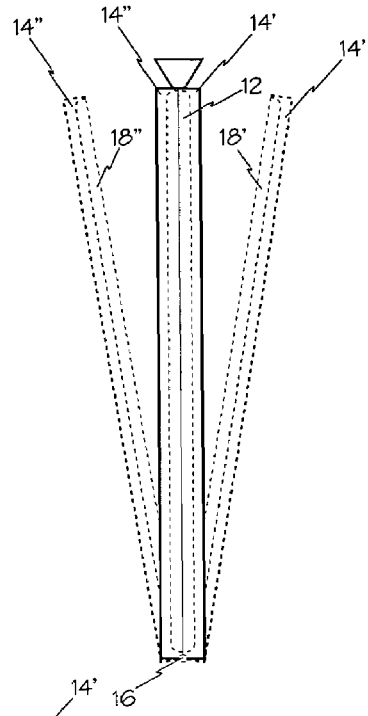
FIG. 2 is an end view of the ring set of FIG. 1.
Figure 3:
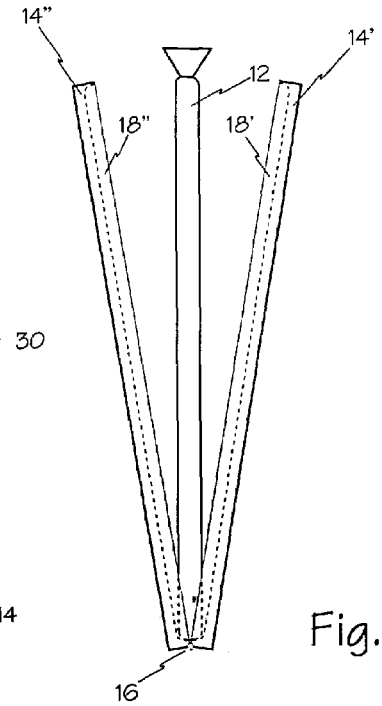
FIG. 3 is an end view of the ring set of FIG. 1 with the secondary ring opened at the hinge.

Referring now to FIG. 2 and FIG. 3, first and second portions 14' and 14" of secondary ring 14 may be pivoted open about hinge 16 as illustrated. First and second portions 14' and 14" may also include one or more ornamental elements that may further engage each other to further secure primary ring 12 within secondary ring 14.

Figure 4:
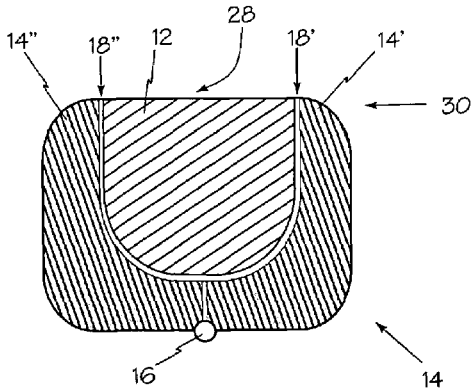
FIG. 4 is a cross section view of the ring set of FIG. 1 taken across the hinge on line 4-4.

Referring now to FIG. 4, in a cross section of ring set 10 relief area 18 of secondary ring 14 engages primary ring 12 such that inner surface 28 of primary ring 12 aligns with inner surface 30 of secondary ring 14.

Figure 5:
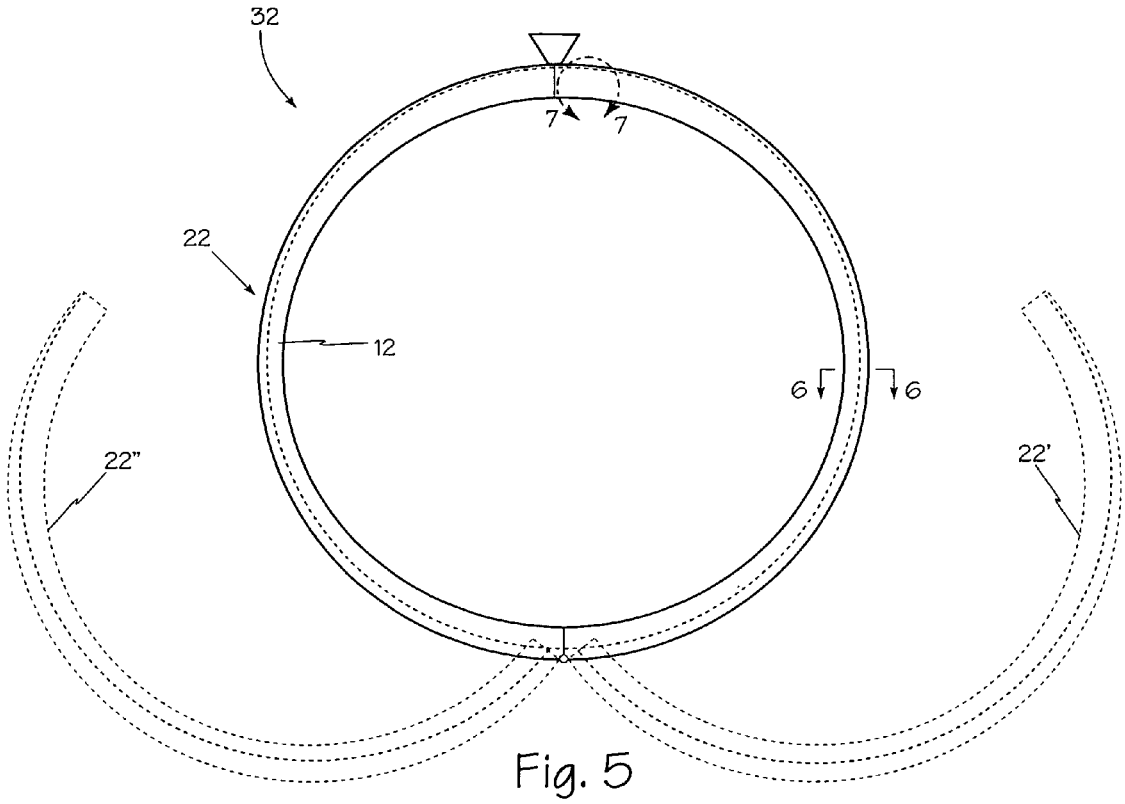
FIG. 5 is a side view of a north-south ring set according to the present disclosure.

Referring now to FIG. 5, in an alternate structure, secondary ring 22 is hinged to engage and enclose primary ring 12 along a north-south axis.

Figure 6:
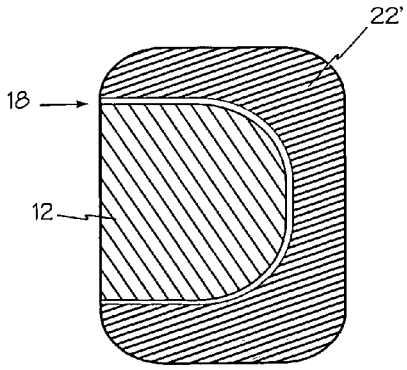
FIG. 6 is a cross section view of the ring set of FIG. 5 taken along line 6-6.

Referring now to FIG. 6 a cross section of ring system 32 illustrates primary ring 12 engaged and enclosed within relief area 18 of secondary ring 22.

Figure 7:
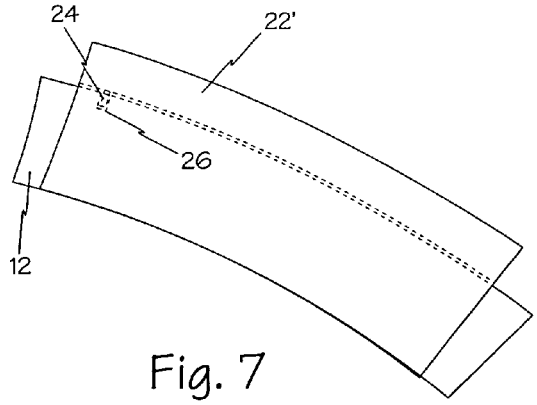
FIG. 7 is a close up view of area 7-7 of the ring set of FIG. 5.

Referring now to FIG. 7 in a close up view of a portion of ring system 32 a suitable engagement element such as engagement element 24 may be formed as an integral element of a portion of a secondary ring such as first portion 22' of secondary ring 22. Engagement elements such as engagement element 24 engage a suitable mating receptacle such as engagement socket 26 of primary ring 12. Any suitable combination of engagement components may be used to secure a primary ring to a secondary ring.

Figure 8:
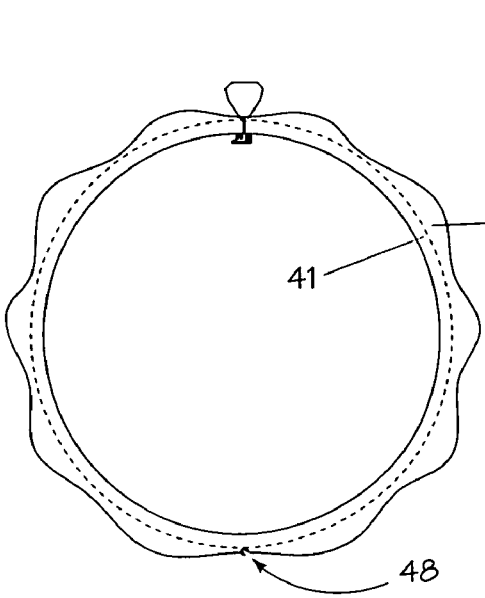
FIG. 8 is a side view of an alternate east-west ring set according to the present disclosure.
Figure 9:
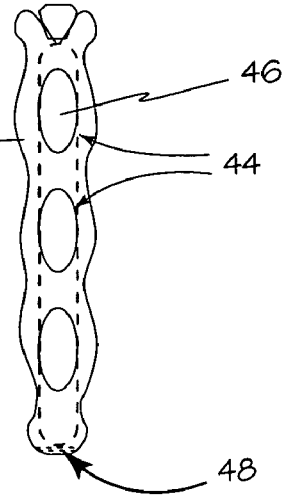
FIG. 9 is an end view of the ring set of FIG. 8.

Referring now to FIG. 8 and FIG. 9, ring set 40 includes a secondary ring 42 that includes multiple apertures 44 to permit viewing secondary areas such as secondary area 46 of primary ring 41. Secondary ring 42 may include a hinge such as hinge 48 to permit opening on an east-west orientation. Alternatively, hinge 48 may be oriented to enable secondary ring 42 to open along a north-south orientation.

Figure 10:
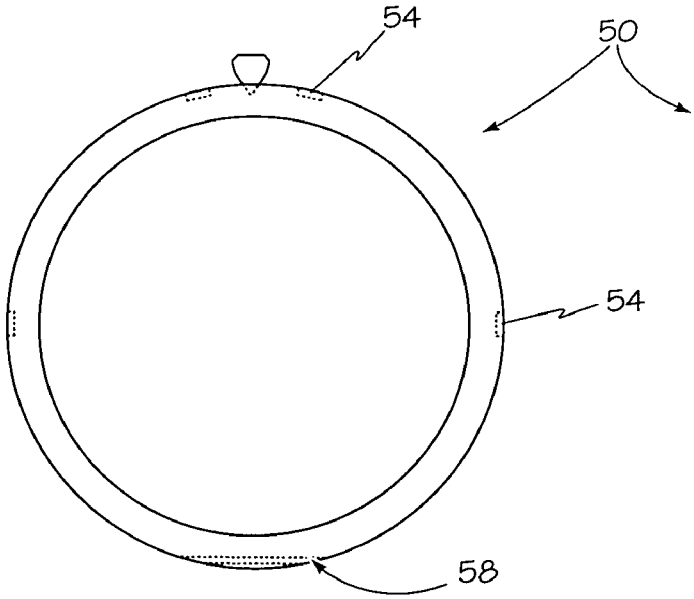
FIG. 10 is a side view of another alternate east-west ring set according to the present disclosure.
Figure 11:
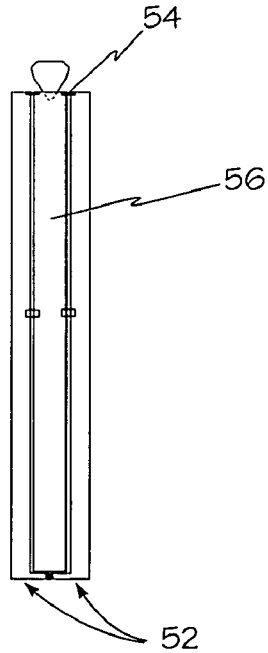
FIG. 11 is an end view of the ring set of FIG. 10.

Referring now to FIGS. 10 and 11, alternate ring set 50 may include primary ring 56 engaged by ringlets 52. Ringlets 52 may be connected using one or more hinges such as hinge 58. Primary ring 56 may engage or be engaged by ringlets 52 by one or more engagement elements such as clasps 54.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A decorative ring set comprising:

a generally toroidal primary ring;

a generally toroidal secondary ring having;

a generally toroidal first portion;

a generally toroidal second portion; and a hinge connecting the first portion to the second portion forming a channel therebetween, the channel sized to engage the primary ring; and one or more engaging elements, engaging the first portion of the secondary ring to the second portion of the secondary ring.

2. A decorative ring set comprising:

a generally toroidal primary ring;

a generally toroidal secondary ring having, an arcuate first portion having an inner channel sized to engage a portion of the primary ring;

an arcuate second portion having an inner channel sized to engage a portion of the primary ring; and a hinge connecting the arcuate first portion to the arcuate second portion enabling the channel to engage the primary ring; and one or more engaging elements, engaging the first portion of the secondary ring to the second portion of the secondary ring.

* * * * *